US010174571B2

(12) United States Patent
Dillard et al.

(10) Patent No.: US 10,174,571 B2
(45) Date of Patent: Jan. 8, 2019

(54) CONTROL OF MULTIPLE HYDRAULIC CHOKES IN MANAGED PRESSURE DRILLING

(71) Applicant: Weatherford Technology Holdings, LLC, Houston, TX (US)

(72) Inventors: Walter S. Dillard, Houston, TX (US); Paul R. Northam, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 235 days.

(21) Appl. No.: 14/988,008

(22) Filed: Jan. 5, 2016

(65) Prior Publication Data

US 2016/0194927 A1 Jul. 7, 2016

Related U.S. Application Data

(60) Provisional application No. 62/099,939, filed on Jan. 5, 2015.

(51) Int. Cl.
*E21B 21/08* (2006.01)
*E21B 21/01* (2006.01)
*E21B 21/00* (2006.01)

(52) U.S. Cl.
CPC ..... *E21B 21/08* (2013.01); *E21B 21/01* (2013.01); *E21B 2021/006* (2013.01)

(58) Field of Classification Search
CPC .... E21B 2021/006; E21B 21/01; E21B 21/08; E21B 21/10
See application file for complete search history.

(56) References Cited

U.S. PATENT DOCUMENTS 3,654,833 A * 4/1972 Griffiths ..... F15B 11/003 91/41
4,493,336 A 1/1985 Renfro
(Continued)

FOREIGN PATENT DOCUMENTS

WO 2013/066655 A1 5/2013

OTHER PUBLICATIONS

Int'l Search Report and Written Opinion in counterpart PCT Appl. PCT/US2016/012134, dated Apr. 21, 2016.
(Continued)

*Primary Examiner* — James G Sayre
(74) *Attorney, Agent, or Firm* — Blank Rome LLP

(57) ABSTRACT

An assembly is used with a remote source of hydraulic power to control flow of wellbore fluid in a drilling system. At least one choke is operable to control the flow of the fluid to other portions of the system. At least one hydraulic actuator disposed with the choke actuates operation of the choke in response to the hydraulic power. At least one control valve disposed with the choke controls supply of the hydraulic power to and controls return of the hydraulic power from the actuator. An accumulator can be disposed with the choke and coupled to the supply upstream of the control valve. The control valve can couple to the actuator with a pair of pilot-operated check valves disposed in fluid communication between the control valve and the actuator. A stage tank and stage pump can be disposed with the choke. The tank receives the return from the control valve, and the stage pump can pump the return from the stage tank to the source.

29 Claims, 6 Drawing Sheets

(56) References Cited

U.S. PATENT DOCUMENTS

| | | | | |
|---|---|---|---|---|
| 6,988,554 | B2 * | 1/2006 | Bodine | E21B 33/0355 166/363 |
| 7,044,237 | B2 | 5/2006 | Leuchtenberg | |
| 7,278,496 | B2 * | 10/2007 | Leuchtenberg | E21B 21/08 166/53 |
| 2005/0092523 | A1 * | 5/2005 | McCaskill | E21B 21/08 175/38 |
| 2012/0111572 | A1 | 5/2012 | Cargol | |
| 2012/0255777 | A1 | 10/2012 | Bernard | |
| 2013/0068532 | A1 * | 3/2013 | Bansal | E21B 21/10 175/218 |
| 2013/0113213 | A1 * | 5/2013 | Yarnold | E21B 41/0085 290/50 |

OTHER PUBLICATIONS

First Examination Report in counterpart AU Appl. 2016205443, dated Feb. 7, 2018.
First Office Action in counterpart CA Appl. 2,972,462; dated Apr. 25, 2018, 3-pgs.

* cited by examiner

CONTROL OF MULTIPLE HYDRAULIC CHOKES IN MANAGED PRESSURE DRILLING

CROSS-REFERENCE TO RELATED APPLICATIONS

This is non-provisional of U.S. Provisional Appl. 62/099,939, filed 5 Jan. 2015, which is incorporated herein by reference in its entirety and to which priority is claimed.

FIELD OF THE DISCLOSURE

The disclosure relates to a method and apparatus to control multiple hydraulic chokes in a managed pressure drilling system.

BACKGROUND OF THE DISCLOSURE

Several controlled pressure drilling techniques are used to drill wellbores. In general, controlled pressure drilling includes managed pressure drilling (MPD), underbalanced drilling (UBD), and air drilling (AD) operations.

In the Managed Pressure Drilling (MPD) technique, a MPD system uses a closed and pressurizable mud-return system, a rotating control device (RCD), and a choke manifold to control the wellbore pressure during drilling. The various MPD techniques used in the industry allow operators to drill successfully in conditions where conventional technology simply will not work by allowing operators to manage the pressure in a controlled fashion during drilling.

During drilling, the bit drills through a formation, and pores become exposed and opened. As a result, formation fluids (i.e., gas) can mix with the drilling mud. The drilling system then pumps this gas, drilling mud, and the formation cuttings back to the surface. As the gas rises up the borehole, the pressure drops, meaning more gas from the formation may be able to enter the wellbore. If the hydrostatic pressure is less than the formation pressure, then even more gas can enter the wellbore.

FIG. 1A schematically shows a controlled pressure drilling system 10 according to the prior art. As shown here, this system 10 is a Managed Pressure Drilling (MPD) system having a rotating control device (RCD) 12 from which a drill string and drill bit (not shown) extend downhole in a wellbore through a formation. The rotating control device 12 can include any suitable pressure containment device that keeps the wellbore closed at all time while the wellbore is being drilled. The system 10 also includes mud pumps (not shown), a standpipe (not shown), a mud tank (not shown), a mud gas separator 18, and various flow lines (14, 16, etc.), as well as other conventional components. In addition to these, the MPD system 10 includes an automated choke manifold 20 that is incorporated into the other components of the system 10.

One suitable example of a drilling system 10 with a choke manifold 20 is the Secure Drilling™ System available from Weatherford. Details related to such a system are disclosed in U.S. Pat. No. 7,044,237, which is incorporated herein by reference in its entirety.

The automated choke manifold 20 manages pressure during drilling and is incorporated into the system 10 downstream from the rotating control device 12 and upstream from the gas separator 18. The manifold 20 has chokes 22A-B, choke actuators 24A-B, a mass flow meter 26, pressure sensors, a hydraulic power unit 50 to actuate the chokes 22A-B, and a controller 40 to control operation of the manifold 20.

The system 10 uses the rotating control device 12 to keep the well closed to atmospheric conditions. Fluid leaving the well flows through the automated choke manifold 20, which measures return flow and density using the flow meter 26 installed in line with the chokes 22A-B. Software components of the manifold 20 then compare the flow rate in and out of the wellbore, the injection pressure (or standpipe pressure), the surface backpressure (measured upstream from the drilling chokes 22), the position of the chokes 22A-B, and the mud density. Comparing these variables, the system 10 identifies minute downhole influxes and losses on a real-time basis and to manage the annulus pressure during drilling. All of the monitored information can be displayed for the operator at the controller 40.

During drilling operations, the controller 40 monitors for any deviations in values and alerts the operators of any problems that might be caused by a fluid influx into the wellbore from the formation or a loss of drilling mud into the formation. In addition, the controller 40 can automatically detect, control, and circulate out such influxes by operating the chokes 22A-B on the choke manifold 20 with the power unit 50.

For example, a possible fluid influx can be noted when the "flow out" value (measured from flow meter 26) deviates from the "flow in" value (measured from the mud pumps). When an influx is detected, an alert notifies the operator to apply the brake until it is confirmed safe to drill. Meanwhile, no change in the mud pump rate is needed at this stage.

In a form of auto kick control, however, the controller 40 automatically closes the choke 22A-B to a determined degree to increase surface backpressure in the wellbore annulus and stop the influx. Next, the controller 40 circulates the influx out of the well by automatically adjusting the surface backpressure, thereby increasing the downhole circulating pressure and avoiding a secondary influx.

On the other hand, a possible fluid loss can be noted when the "flow in" value (measured from the pumps) is greater than the "flow out" value (measured by the flow meter 26). Similar steps as those above but suited for fluid loss can then be implemented by the controller 40 to manage the pressure during drilling in this situation.

When the managed pressure drilling system 10 is deployed on a drilling rig floor, hydraulic power is typically supplied remotely to the chokes 22A-B of the system 10. As shown in FIG. 1B, a hydraulic power unit 50 includes a hydraulic reservoir 52, one or more hydraulic pumps 54, one or more accumulators 56, hydraulic choke control valves 58A-B, and necessary piping, fittings, and valves. Each choke 22A-B located in the choke unit 20 has its actuator 24A-B connected by flow paths 55A-B to one of the hydraulic choke control valves 58A-B located in hydraulic power unit 50.

As will be appreciated, the flow-paths 55A-B for the hydraulic power used to control the chokes 22A-B may need to travel some distance (e.g., 12 ft. or so). Additionally, the flow paths 55A-B can be coupled with various bends, not necessarily depicted in this schematic view. Further, wave pulses may tend to originate from the pump(s) 54 and travel along the flow paths 55A-B.

Moreover, any hydraulic hoses used for the flow-paths 55A-B can elastically expand (i.e., expand diametrically) as the hydraulic pressure increases. Conversely, the hydraulic hoses used for the flow-paths 55A-B can elastically contract (i.e., contract diametrically) as the hydraulic pressure decreases. When the length of the hoses for the flow-paths 55A-B is long, a large volume of fluid can be contained in the hoses, thereby causing measurable increases and decreases in hydraulic fluid volume corresponding to these pressure changes. As a result, the hoses for the flow-paths 55A-B can effectively respond as an accumulator and can further exaggerate or reduce the responsiveness of the choke actuators.

Consequently, the distance, bends, wave pulses, and the like can create hydraulic frictional losses and delays that hinder the response of the chokes 22A-B during operations. Moreover, when managed pressure drilling uses two or more chokes 22A-B in simultaneous operation, the hydraulic losses in the flow-path 55A can be different from the hydraulic losses in flow-path 55B depending on construction of the materials or differences in geometries. This can lead to a different system response between the chokes 22A-B, which requires a more complex control algorithm for the controller 40. For example, one hydraulic choke 22A may tend to respond more slowly than the other choke 22B.

It is recognized that electric actuation of the chokes 22A-B may have faster response times (i.e., closing and opening times for the chokes 22A-B) when compared to hydraulic actuation. However, electric actuation on the drilling rig may not be desirable or even possible for various reasons so that hydraulic actuation may be preferred.

What is needed is a way to mitigate any timing differences that may occur when multiple hydraulic chokes are operating simultaneously, as well as improve the response of individual chokes in a choke manifold for a drilling system. Therefore, the subject matter of the present disclosure is directed to overcoming, or at least reducing the effects of, one or more of the problems set forth above.

SUMMARY OF THE DISCLOSURE

According to the present disclosure, an assembly is used with remote hydraulic power to control flow of wellbore fluid in a drilling system. The assembly includes at least one choke, at least one hydraulic actuator, and at least one control valve. The at least one choke is operable to control the flow of the wellbore fluid to other portions of the drilling system. The at least one hydraulic actuator is disposed with the at least one choke and actuates operation of the at least one choke in response to the hydraulic power. The at least one control valve is disposed with the at least one choke. The at least one control valve controls supply of the remote hydraulic power to the at least one hydraulic actuator and controls return of the remote hydraulic power from the at least one hydraulic actuator.

A skid or a manifold can have the at least one choke, the at least one hydraulic actuator, and the at least one control valve disposed thereon. Also, a housing can have the at least one control valve and can be connected to the hydraulic actuator. At least one accumulator can be disposed with the at least one choke and can be coupled to the supply upstream of the at least one control valve.

The at least one control valve can couple to the hydraulic actuator with a pair of pilot-operated check valves disposed in fluid communication between the at least one control valve and the hydraulic actuator. Additionally, a stage tank can be disposed with the at least one choke and can receive the return of the remote hydraulic power from the at least one control valve. In this case, a pump in fluid communication with the stage tank can be operable to pump the return from the stage tank.

The at least one control valve can be electrically operable between a first state of no flow, a second state of parallel flow, and a third state of cross flow between the supply and the return with the at least one hydraulic actuator. Finally, a controller can control operation of at least the at least one control valve.

As noted above, the assembly can have at least one choke, at least one hydraulic actuator, and at least one control valve. In various embodiment, the assembly can have at least two (e.g., two or more) chokes. At least two hydraulic actuators can be disposed respectively with the at least two chokes to actuate operation of the respective chokes in response to hydraulic power. At least two control valves can be disposed respectively with the at least two chokes. The at least two control valves can control supply of the remote hydraulic power respectively to the at least two hydraulic actuators and can control return of the remote hydraulic power respectively from the at least two hydraulic actuators.

In this arrangement, a first juncture disposed with the at least two chokes can split a common supply line of the supply to at least two supply legs connected respectively to the at least two control valves. Also, a second juncture disposed with the at least two chokes can combine at least two return legs connected respectively from the at least two control valves to a common return line of the return.

The assembly can further include a source of the remote hydraulic power having a supply line and a return line. The at least one choke, the at least one hydraulic actuator, and the at least one control valve can be disposed away from the source of the remote hydraulic power. For example, a first skid can have the source, while a second skid can have the at least one choke, the at least one hydraulic actuator, and the at least one control valve disposed thereon.

The source can include a reservoir and a pump. The reservoir is coupled to the return line, and the pump is coupled to the reservoir and the supply line and is operable to provide the hydraulic power via the supply line. The source can also have an accumulator accumulating the supply of the remote hydraulic power.

According to the present disclosure, a method is used with a remote source of hydraulic power to control flow of wellbore fluid in a drilling system. The method involves disposing at least one hydraulic actuator and at least one control valve with at least one choke and controlling the flow of the wellbore fluid to other portions of the drilling system by operating the at least one choke with the at least one hydraulic actuator. The hydraulic actuator is operated in the method with the hydraulic power by controlling, with the at least one control valve, supply of the hydraulic power from the remote source to the at least one hydraulic actuator, and controlling, with the at least one control valve, return of the hydraulic power to the remote source from the at least one hydraulic actuator.

Disposing the at least one hydraulic actuator and the at least one control valve with the at least one choke can involve disposing them together on a skid. The method can further include disposing at least one accumulator with the at least one choke, and accumulating the supply of the hydraulic power upstream of the at least one control valve.

The method can further include disposing a pair of pilot-operated check valves in fluid communication between the at least one control valve and the hydraulic actuator, and controlling the supply and the return with the pair of pilot-operated check valves. The method can further include receiving the return of the hydraulic power from the at least one control valve at a stage tank disposed with the at least one choke, and pumping the return from the stage tank to the remote source with a pump disposed with the at least one choke.

In the method, disposing the at least one hydraulic actuator and the at least one control valve with the at least one choke can involve housing the at least one control valve to the hydraulic actuator. Also, controlling with the at least one control valve can include electrically operating the at least one control valve between a first state of no flow, a second state of parallel flow, and a third state of cross flow between the supply and return with the at least one hydraulic actuator.

The foregoing summary is not intended to summarize each potential embodiment or every aspect of the present disclosure.

DETAILED DESCRIPTION OF THE DISCLOSURE

Systems and methods disclosed herein can be used to control one or more hydraulic chokes in a managed pressure drilling system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

Figure 1A:
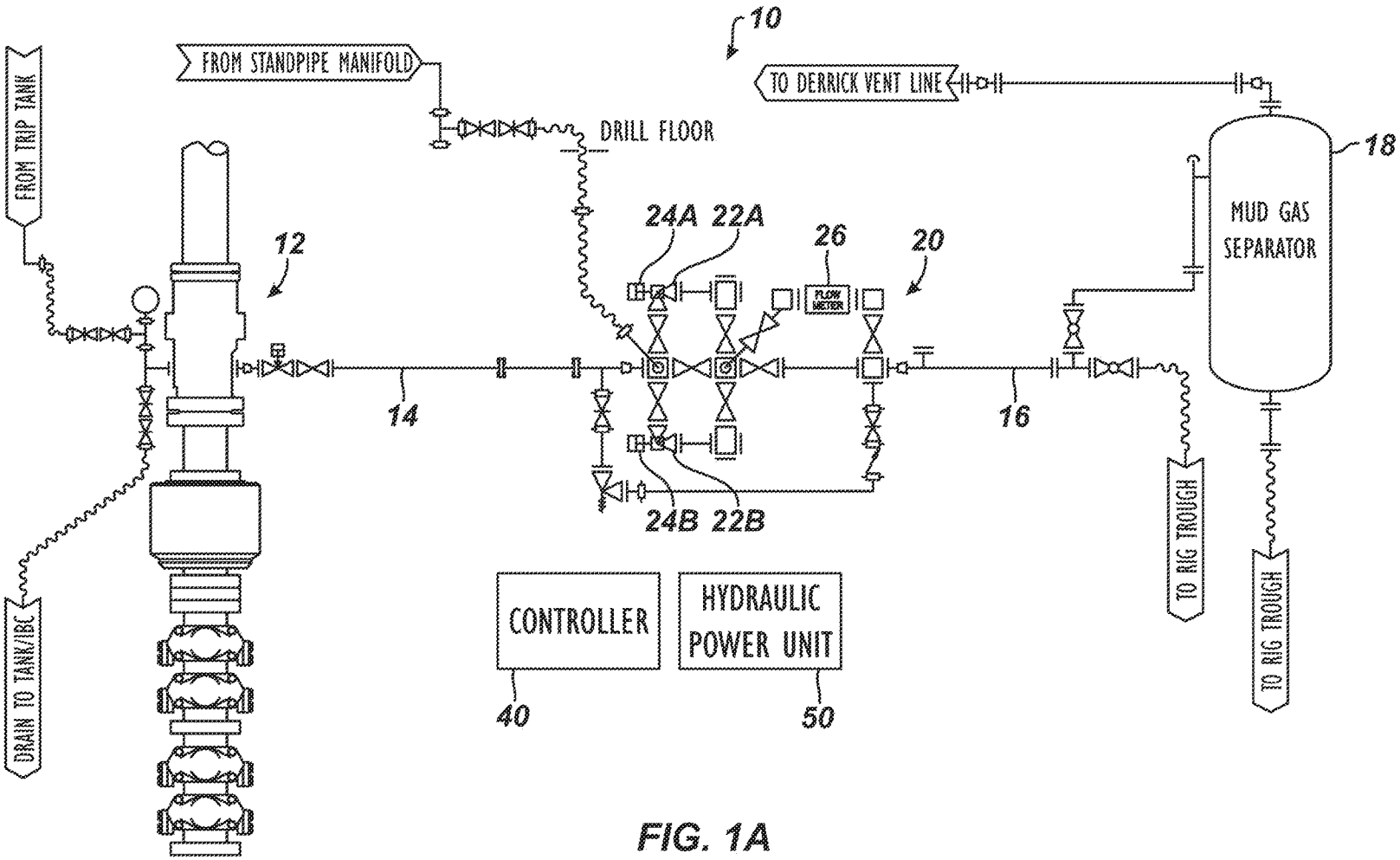
FIG. 1A (Prior Art)
FIG. 1A diagrammatically illustrates a managed pressure drilling system having a choke manifold according to the prior art.
Figure 1B:
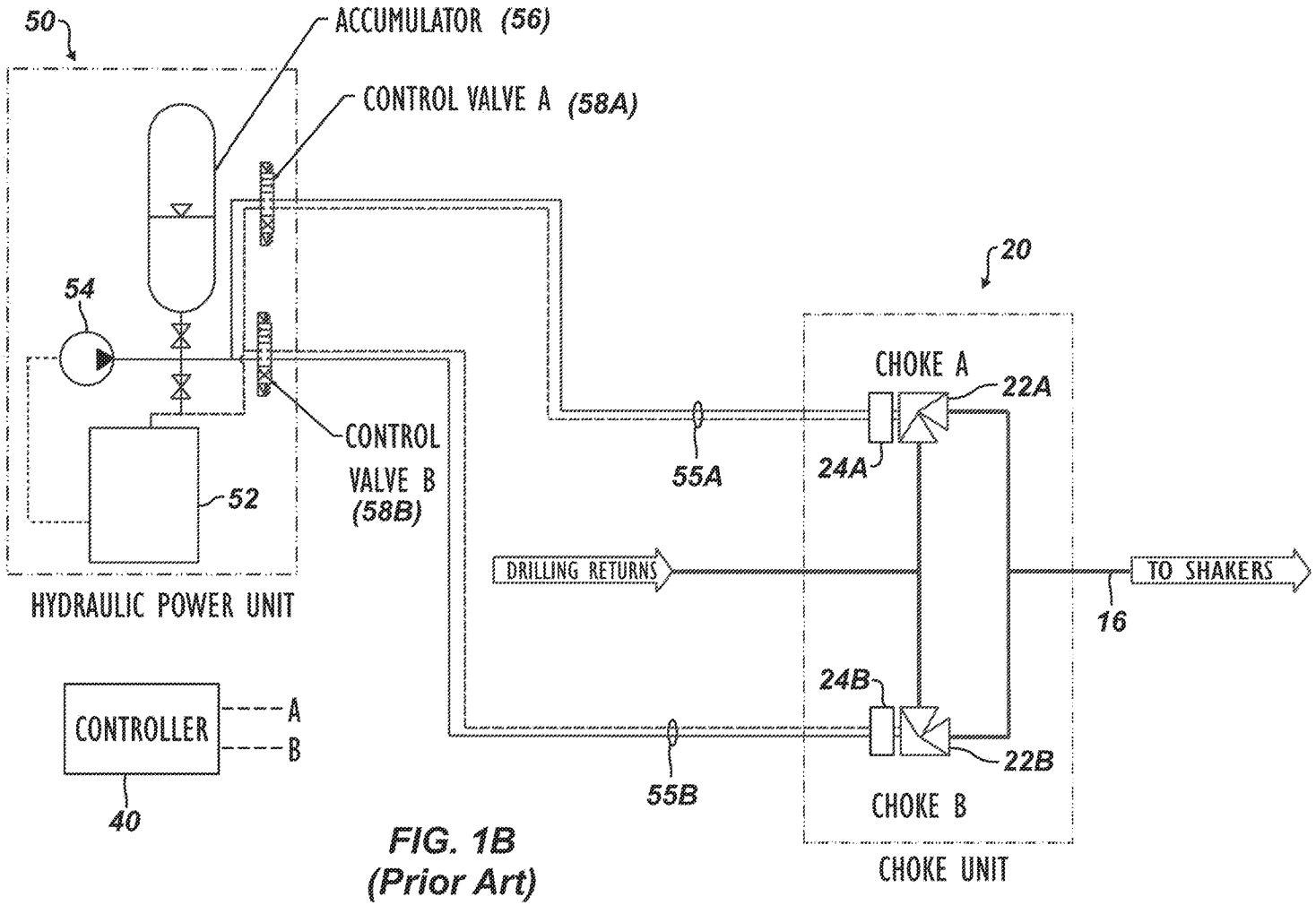
FIG. 1B (Prior Art)
FIG. 1B schematically illustrates features of the prior art choke manifold.
Figure 2A:
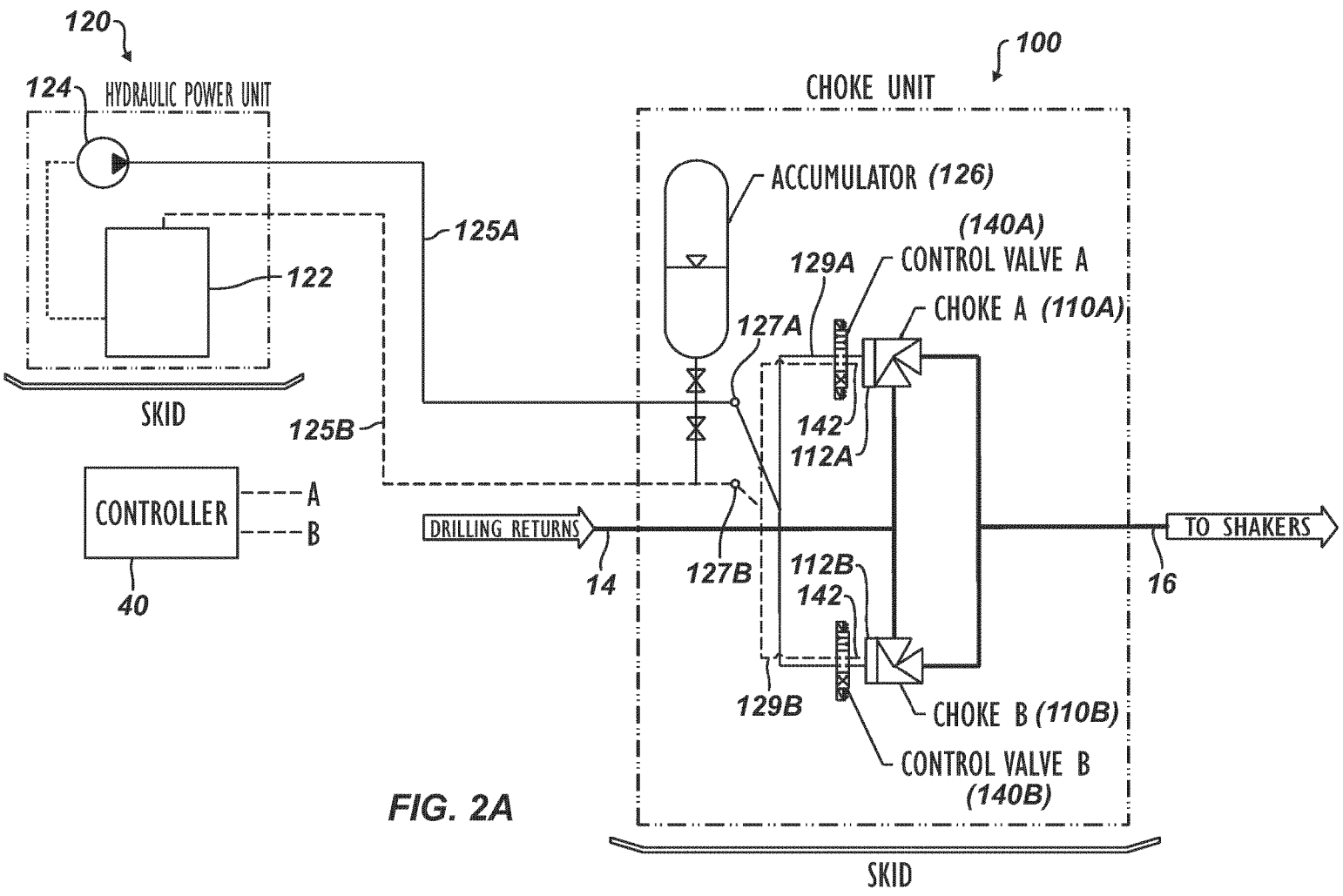
FIG. 2A schematically illustrates one arrangement of a hydraulic power unit and a choke manifold according to the present disclosure.
Figure 6:
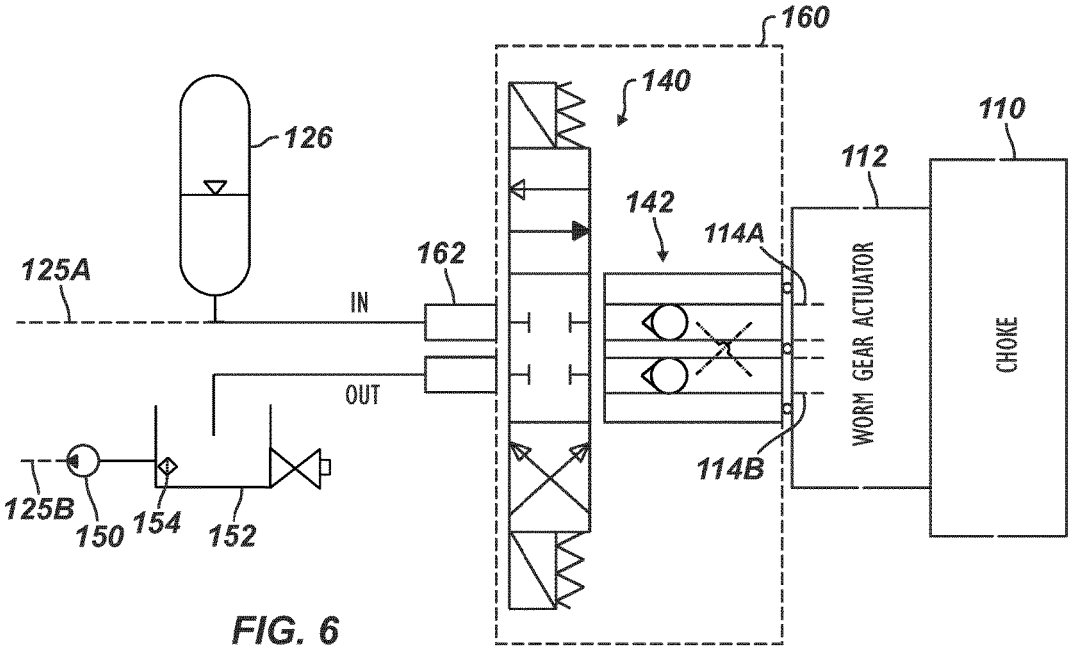
FIG. 6 schematically illustrates a choke having an integrated arrangement of a control valve, pilot-operated check valves, and a hydraulic actuator.

As shown in one arrangement of FIG. 2A, a hydraulic power unit 120 includes a hydraulic reservoir 122, one or more hydraulic pumps 124, and necessary piping, fittings and valves. These components can be housed together on a skid or manifold. A supply line 125A from the pumps 124 communicates the hydraulic power to the choke unit 100 positioned some distance away from the power unit 120. In a similar fashion, a return line 125B from the control unit 100 returns the hydraulics to the reservoir 122. Each choke 110A-B is actuated by a hydraulic actuator 112A-B controlled by one of the hydraulic choke control valves 140A-B located with the choke 110A-B. The independent control valves 140A-B are used to mitigate differences in the chokes 110A-B and provide independent feedback control of the chokes 110A-B. Pilot-actuated check valves 142 can be disposed between the control valves 140A-B and the chokes' actuators 112A-B, as shown in FIG. 6. These components of the choke unit 100 can be housed together on a skid or manifold.

The control valve 140A-B typically has three settings, such as a closed setting closing off both supply and return lines 125A-B, an open setting permitting parallel flow through the lines 125A-B, and a cross-setting that switches the flow direction between the lines 125A-B. The control valves 140A-B can be operated by solenoid valves or the like with control signals from control lines A and B of the controller 40, as noted herein. In turn, the hydraulic power directed by the control valve 140A-B operates the respective hydraulic actuators 112A-B for the chokes 110A-B.

The supply line 125A communicates hydraulic power from the power unit 120 to a supply splitter 127A, which splits the communication to parallel supply legs 129A connected to the control valves 140A-B. Conversely, parallel return legs 129B connect from the control valves 140A-B to a return splitter 127B, which combines the communication to the return line 125B.

With the disclosed configuration, the lengths of the hydraulic communication between the choke actuators 112A-B and the corresponding hydraulic choke control valve 140A-B are significantly reduced or eliminated. As noted above, any hydraulic hoses used for the flow-paths can elastically expand (i.e., expand diametrically) as the hydraulic pressure increases and can elastically contract (i.e., contract diametrically) as the hydraulic pressure decreases. As a result, measurable increases and decreases in hydraulic fluid volume can occur due to the pressure changes and can exaggerate or reduce the responsiveness of the choke actuators. Here, however, the choke control valves 140A-B are located in proximity to the actuators 112A-B so that long hydraulic hoses and large volumes of hydraulic fluid are no longer used between the control valves 140A-B and the choke actuators 112A-B. Overall, this configuration of FIG. 2A can improve the choke response.

Additionally, the mounting of each hydraulic choke control valve 140A-B can be arranged such that the lengths of hydraulic lines 129A-B after the splitters 127A-B to the control valves 140A-B can match and the number of fittings between the splitters 127A-B and each choke 110A-B can be the same. (In general, the hydraulic lines 125A-B from the power unit 120 to the splitters 127A-B do not necessarily need a matching length and the like, although they could.)

In particular, having the control valves 140A-B located directly adjacent to each choke actuator 112A-B allows the one main supply line 125A and matching supply legs 129A after the supply splitter 127A to be used to operate both the chokes 110A-B. The single hydraulic supply line 125A splits off with the supply splitter or juncture 127A at or near the location of the chokes 140A-B to the matching supply legs 129A so that the hydraulic losses to each choke 110A-B can be relatively equal. This split arrangement of the return legs 129B, return splitter 127B, and the single return line 125B can also be used for the hydraulic returns of the chokes 110A-B to the power unit 120. The arrangement of lines 125A-B, splitters 127A-B, and split legs 129A-B in this manner can make any potential hydraulic losses between each choke 110A-B and the hydraulic power relatively the same.

Because the choke unit 100 can use one common hydraulic line 125A from the power unit 120, one or more accumulators 126 can be located with the chokes 110A-B instead of being located at the power unit 120. With the accumulators 126 located in this way, the hydraulic response time for the set of two or more chokes 110A-B can be reduced. Using the accumulator(s) 126 can also minimize the response time should the choke unit 100 use a single choke 110.

As noted above, wave pulses originating from a pump can adversely affect choke performance. In the present arrangement with the control valves 140A-B (and optionally the accumulator(s) 126) positioned away from the one or more pumps 124, any potential wave pules generated by the pumps 124 can be dampened, which can improve the choke response. In fact, a damper (not shown), such as a biased piston, could be added downstream of the one or more pumps 124. Additionally, the particular type of pump 124 used can further reduce any potential pulses.

Moreover, the common supply line 125A, which can use larger or more rigid tubing, to deliver hydraulic fluid near the chokes 110A-B before splitting at the splitter 127 to supply the dual control valves 140A-B and choke actuators 112A-B can reduce effects of tubing oscillation in the hydraulic system. Likewise, having shorter lines of communication after the accumulator 126 can reduce the total volume of hydraulic fluid between the accumulator 126 and chokes' actuators 112A-B, thus providing faster response.

As shown in FIG. 2A, one accumulator 126 can couple to both the return and the supply. Connection of the accumulator 126 to the return may allow for bleed down of the accumulator 126 and may not be needed. Alternatively, the use of two accumulators 126, one for each of the split legs 129A-B may help improve the chokes' response times by shortening the distance between the stored energy and the hydraulic actuators 112A-B. Having two smaller accumulators 126 compared to a single larger one may also allow for different space requirements on the skid or manifold for the choke unit 100. If human intervention is required to bypass the chokes 110A-B, it may be facilitated by having the accumulator 126 close to the chokes 110A-B since the accumulator 126 needs to be isolated before the choke 110A-B is manually bypassed.

In some additional features, lighter components can be used in the solenoid of the control valve 140 to improve its response. Quick disconnects can be used for the various couplings and fittings in the hydraulic system. If the quick disconnect affects the choke's response, this could be mitigated by moving the quick disconnect to just upstream of the actuators 112A-B. For repair or maintenance, each actuator 112A-B and choke 110A-B can be integrated as a unit. This makes sense from an assembly standpoint since different choke-actuator combinations are not typically used.

As noted above, FIG. 2A shows an arrangement where the hydraulic power unit 120 can be implemented as one skid or manifold that couples by the lines 125A-B to the choke unit 100 implemented as another skid or manifold having dual chokes 110A-B and the other components. Other arrangements are possible. For example, one skid having a hydraulic power unit 120 can operate a single choke 110, which can be housed on another skid.

Figure 2B:
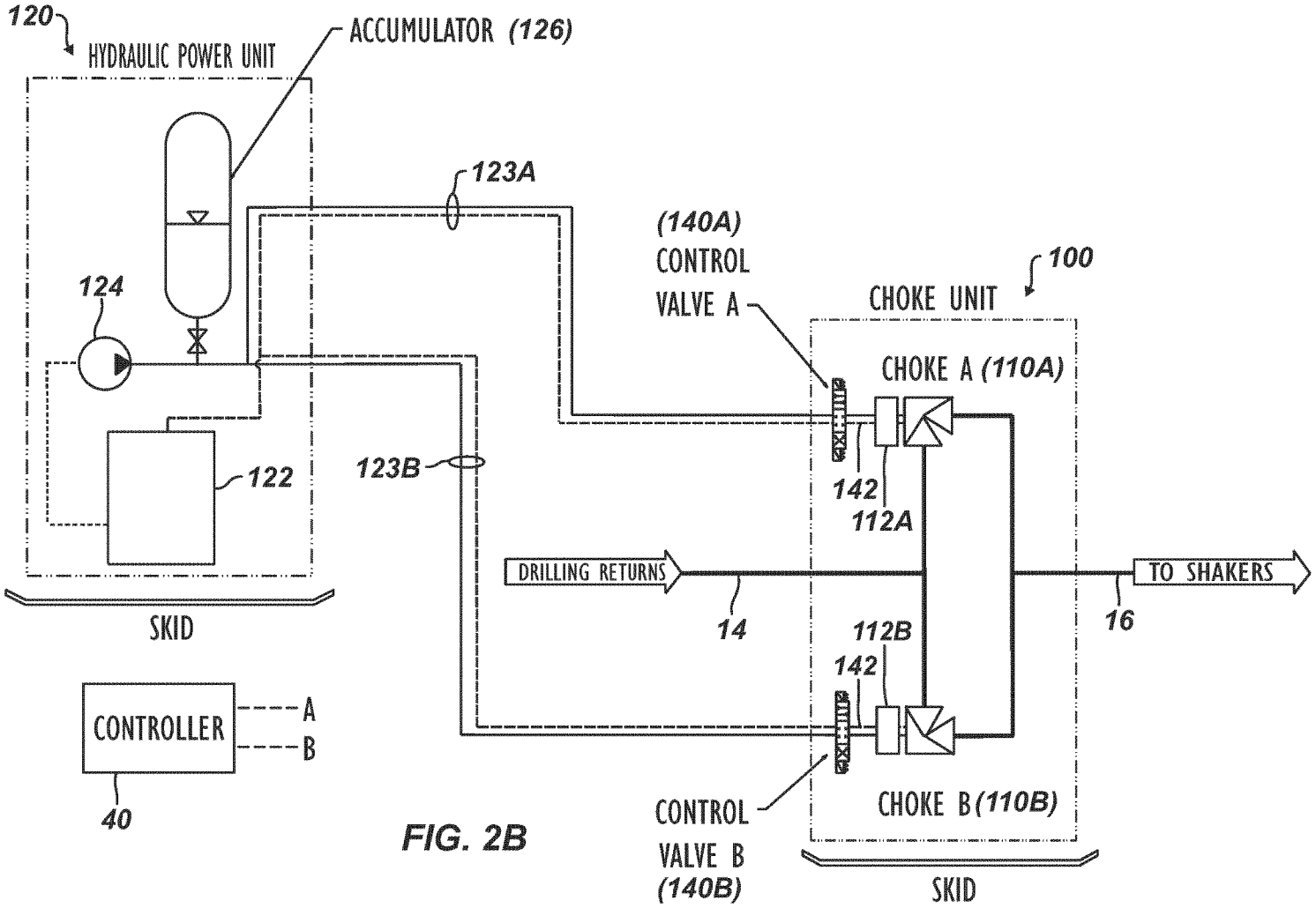
FIG. 2B schematically illustrates another arrangement of a hydraulic power unit and a choke manifold according to the present disclosure.

As shown in another arrangement of FIG. 2B, the hydraulic power unit 120 includes the hydraulic reservoir 122, the one or more hydraulic pumps 124, the accumulator 126, and necessary piping, fittings, and valves. These components can be housed together on a skid or manifold. First supply and return lines 123A from the pumps 124 communicate the hydraulic power and returns between the power unit 120 and the choke unit 100 positioned some distance away from the power unit 120. In a similar fashion, second supply and return lines 123B communicate the hydraulic power and returns between the power unit 120 and the choke unit 100.

Each choke 110A-B is actuated by its hydraulic actuator 112A-B controlled by one of the hydraulic choke control valves 140A-B located with the choke 110A-B. As noted previously, the localized control valves 140A-B are used to mitigate differences in the chokes 110A-B and provide independent feedback control of the chokes 110A-B. Pilot-actuated check valves 142 can be disposed between the control valves 140A-B and the chokes' actuators 112A-B. These components of the choke unit 100 can be housed together on a skid or manifold.

Figure 3:
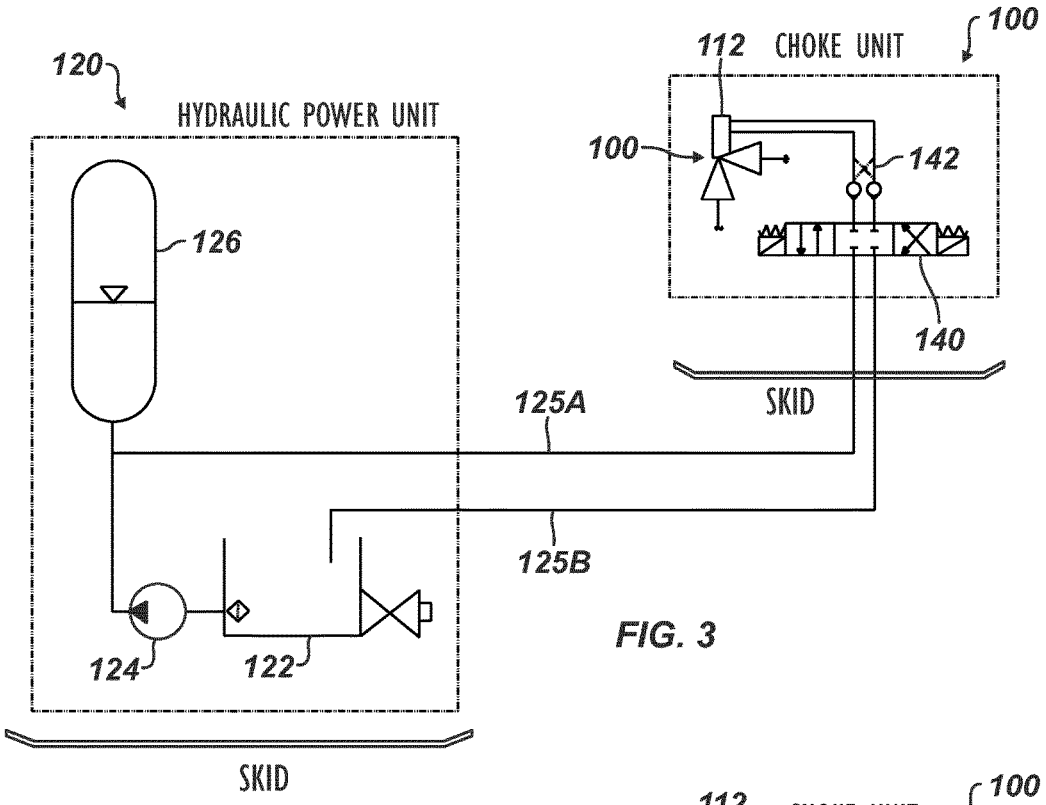
FIGS. 3-5 schematically illustrate additional arrangements hydraulic power units and choke manifolds according to the present disclosure.
Figure 4:
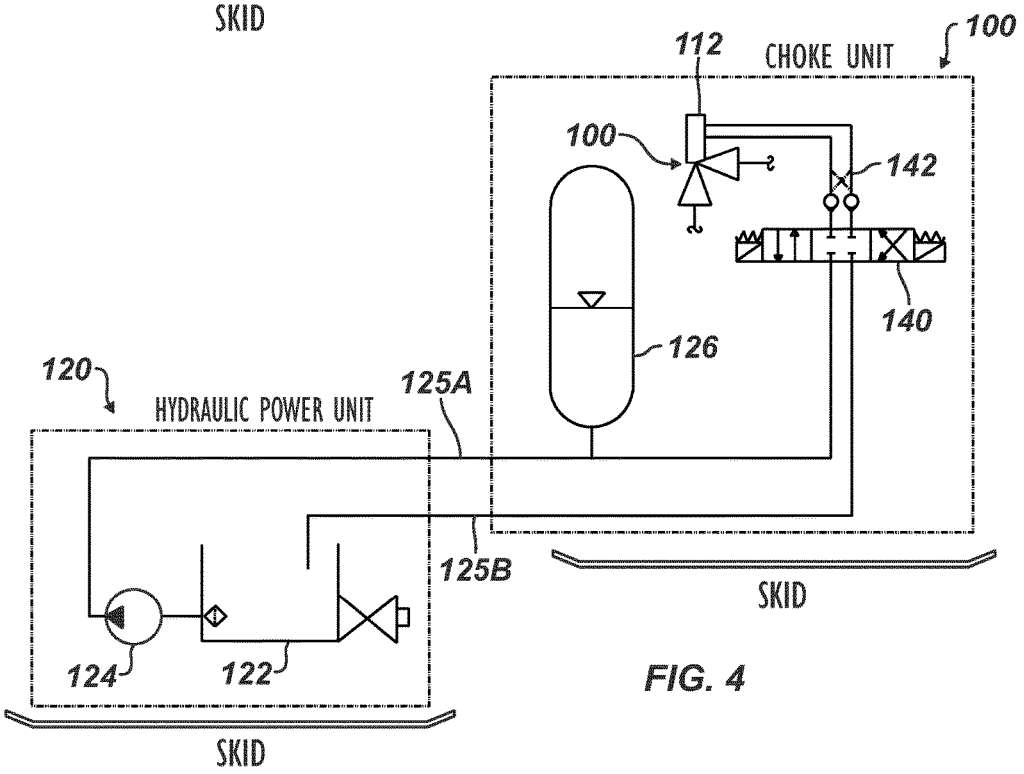
Figure 5:
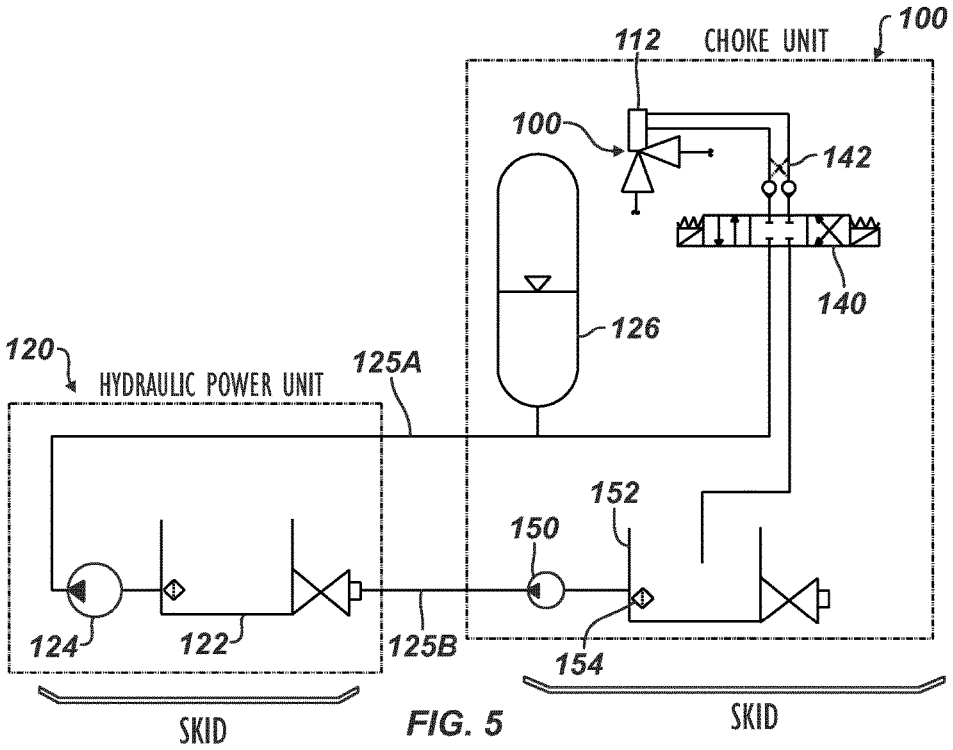

FIGS. 3-5 schematically illustrate additional arrangements hydraulic power units 120 and choke units 100 according to the present disclosure. In FIG. 3, the hydraulic power unit 120 includes a tank or reservoir 122, a pump 124, and an accumulator 126. These components are implemented on a skid or manifold for the unit 120 and connect by supply and return lines 125A-B to the choke unit 100, which can be housed on a separate skid or manifold.

As shown here, the choke unit 100 includes a choke 110, a hydraulic actuator 112, and a control valve 140. Pilot-operated check valves 142 may be used between the control valve 140 and the choke's actuator 112. This arrangement places the hydraulic switching of hydraulic power from the power unit 120 at, near, or on the choke 110 of the choke unit 100, which can have a number of benefits as disclosed herein.

FIG. 4 shows a similar arrangement to FIG. 3 except that the choke unit 100 includes the accumulator 126 on its skid near the choke 110. As noted herein, the accumulator 126 on the supply line 125A can have a number of benefits stemming from its close proximity to the choke 110.

Backpressure in the hydraulic return line 125B downstream of the choke 110 can be another consideration in choke response. The return tank 122 can be moved closer to the choke 110 to reduce backpressure. Alternatively, a second tank can be added to the return to help deal with backpressure. For example, FIG. 5 shows an additional arrangement in which components (e.g., control valve 140, actuator 112, choke 110, accumulator 126, etc.) are disposed at the choke unit 100. Here, the choke unit 100 further includes an auxiliary pump 150 and a stage tank 152 on the return from the control valve 140. As high pressure hydraulics are communicated to the choke 110 via the high-pressure supply line 125A to actuate the choke 110 with the actuator 112, expended hydraulics from the control valve 140 travel along the low-pressure return to the stage tank 152, which can be exposed to atmospheric pressure. This produces an advantageous pressure differential close to the control valve 140 so that its operation can be faster and so the choke response can be improved.

Expended fluid in the collection tank 152 can then be pumped by the auxiliary pump 150 to the reservoir tank 122 on the hydraulic power unit 120 via the return line 125B. As shown in FIG. 5, the stage tank 152 can include a level sensor 154. When the fluid reaches a certain level in the stage tank 152, the auxiliary pump 150 can pump fluid back to the unit's main tank 122. Since the distance along the return line 125B can be quite long (e.g., 12-ft. or so), use of the auxiliary pump 150 and collection tank 152 can facilitate the travel of the expelled fluid back to the reservoir tank 122 by reducing the line friction and any potential backpressure that the expelled fluid might otherwise encounter.

As can be seen, the addition of the stage tank 152 as in FIG. 5 immediately downstream of the choke 110 can improve sluggish choke response. The hydraulic fluid from the choke actuator 112 can empty directly at atmospheric pressure into the stage tank 152 to then be pumped back by the auxiliary pump 150. This can eliminate the extended and closed return line typically used to return expelled fluid to the hydraulic power unit 120.

As detailed above, sluggish choke response can be caused by backpressure in both the supply and return of the hydraulic power. As in the various arrangements disclosed above, integrating hydraulic components closer to choke 110 and its actuator 112 can improve the sluggish choke response and improve operation. With that said, some of these hydraulic components can be affixed to, integrated into, or otherwise made part of the choke 110 and its actuator 112.

For example, FIG. 6 shows an arrangement of a control valve 140, a hydraulic actuator 112, and a choke 110 for the choke unit 100. The supply line 125A and return line 125B couple by fittings 162 to an adapter or housing 160. As shown, the housing 160 can hold the control valve 140 and its related components, such as the pilot-actuated check valves 142 and solenoid (not shown). As before, the supply line 125A can include an accumulator 126 that is mounted on the choke unit 100 near the choke 110. The return line 125B can couple to the collection tank 152 and auxiliary pump 150 as before to return expended hydraulics from the choke 110.

In general, the housing 160 can be affixed to or incorporated into the hydraulic actuator 112 for the choke 110. For example, the housing 160 can be sealed in communication with hydraulic ports 114 of the hydraulic actuator 112 using gaskets, seals, etc. In this way, the housing 160 can be used to retrofit or integrate with an existing choke actuator and can be configured to do so in a number of ways.

In some arrangements, for example, the hydraulic actuator 112 for the choke 110 can be a worm gear actuator. High-pressure fluid communicated from the control valve 140 to a first port 114A can rotate the worm gear to close the choke 110 while low-pressure fluid is expelled from a second port 1148. In the reverse, high-pressure fluid communicated from the control valve 140 to the second port 1148 can rotate the worm gear to open the choke 110 while low-pressure fluid is expelled from the first port 114A. Meanwhile, the control valve 140 directs the high-pressure fluid from the supply line 125A and returns the low-pressure fluid to the return line 125B.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly used with remote hydraulic power communicated between first and second remote locations to control flow of wellbore fluid in a drilling system, the first remote location separated by a distance from the second remote location, the assembly comprising:

at least one choke disposed at the first remote location and operable to control the flow of the wellbore fluid to other portions of the drilling system;

at least one hydraulic actuator disposed with the at least one choke at the first remote location and having first and second hydraulic ports, the at least one hydraulic actuator actuating operation of the at least one choke in response to the remote hydraulic power communicated with the first and second hydraulic ports; and at least one control valve disposed with the at least one choke at the first remote location, the at least one control valve having at least two states connecting a supply and a return of the remote hydraulic power to the first and second hydraulic ports, the at least one control valve in a first of the at least two states to open the at least one choke controlling the supply of the remote hydraulic power to the first hydraulic port of the at least one hydraulic actuator and controlling the return of the remote hydraulic power from the second hydraulic port of the at least one hydraulic actuator to the second remote location, the at least one control valve in a second of the at least two states to close the at least one choke crossing the supply and the return relative to the first and second hydraulic ports.

2. The assembly of claim 1, further comprising a skid having the at least one choke, the at least one hydraulic actuator, and the at least one control valve disposed thereon.

3. The assembly of claim 1, further comprising at least one accumulator disposed with the at least one choke at the first remote location and coupled to the supply upstream of the at least one control valve.

4. The assembly of claim 1, wherein the at least one control valve couples to the at least one hydraulic actuator with a pair of pilot-operated check valves disposed in fluid communication between the at least one control valve and the first and second hydraulic ports of the at least one hydraulic actuator.

5. The assembly of claim 1, further comprising a housing having the at least one control valve and being connected to the first and second hydraulic ports of the at least one hydraulic actuator.

6. The assembly of claim 1, further comprising a stage tank disposed with the at least one choke at the first remote location and receiving the return of the remote hydraulic power from the at least one control valve.

7. The assembly of claim 6, further comprising a stage pump in fluid communication with the stage tank and being operable to pump the return from the stage tank.

8. The assembly of claim 1, wherein the at least one control valve is electrically operable between the at least two states.

9. The assembly of claim 1, further comprising a controller controlling operation of at least the at least one control valve.

10. The assembly of claim 1, wherein the at least one choke comprises two or more chokes operable to control the flow of the wellbore fluid to the other portions of the drilling system; wherein the at least hydraulic actuator comprises two or more hydraulic actuators disposed respectively with the two or more chokes at the first remote location and actuating operation of the respective chokes in response to the remote hydraulic power; and wherein the at least control valve comprises two or more control valves disposed respectively with the two or more chokes at the first remote location, the two or more control valves controlling the supply of the remote hydraulic power respectively to the two or more hydraulic actuators and controlling the return of the remote hydraulic power respectively from the two or more hydraulic actuators.

11. The assembly of claim 10, comprising a first juncture disposed with the two or more chokes at the first remote location and splitting a common supply line of the supply to two or more supply legs connected respectively to the two or more control valves.

12. The assembly of claim 11, comprising a second juncture disposed with the two or more chokes at the first remote location and combining two or more return legs connected respectively from the two or more control valves to a common return line of the return.

13. The assembly of claim 10, further comprising at least one accumulator disposed with the two or more chokes at the first remote location and coupled to the supply upstream of the two or more control valves.

14. The assembly of claim 10, wherein the two or more control valves each couples to the respective hydraulic actuator with a pair of pilot-operated check valves disposed in fluid communication between the each control valve and the respective hydraulic actuator.

15. The assembly of claim 1, further comprising a source of the remote hydraulic power disposed at the second remote location and having a supply line for the supply and a return line for the return, wherein the at least one choke, the at least one hydraulic actuator, and the at least one control valve are disposed at the first remote location away from the source of the remote hydraulic power.

16. The assembly of claim 15, wherein the source comprises:

a reservoir coupled to the return line; and a source pump coupled to the reservoir and the supply line, the source pump operable to provide the hydraulic power via the supply line.

17. The assembly of claim 15, further comprising a stage tank disposed with the at least one choke at the first remote location and receiving the return of the remote hydraulic power from the at least one control valve.

18. The assembly of claim 17, further comprising a stage pump in fluid communication with the stage tank and being operable to pump the return from the stage tank to the source.

19. The assembly of claim 15, wherein the source comprises an accumulator accumulating the supply of the remote hydraulic power.

20. The assembly of claim 15, comprising a first skid disposed at the second remote location and having the source; and a second skid disposed at the first remote location and having the at least one choke, the at least one hydraulic actuator, and the at least one control valve disposed thereon.

21. The assembly of claim 1, wherein the at least one control valve has a third of the at least two states closing of fluid communication of the supply and the return with the first and second ports.

22. A method used with a remote source of hydraulic power communicated between first and second remote locations to control flow of wellbore fluid in a drilling system, the first remote location separated by a distance from the second remote location, the method comprising:

disposing at least one hydraulic actuator and at least one control valve with at least one choke disposed at the first remote location, the at least one hydraulic actuator having first and second hydraulic ports and actuating operation of the at least one choke in response to the remote hydraulic power communicated with the first and second hydraulic ports;

controlling the flow of the wellbore fluid to other portions of the drilling system by operating the at least one choke with the at least one hydraulic actuator; and operating the at least one hydraulic actuator with the hydraulic power communicated between the first and second remote locations by— controlling, with the at least one control valve disposed at the first remote location in a first of the at least two states to open the at least one choke, a supply of the hydraulic power from the remote source to the first hydraulic port of the at least one hydraulic actuator, and controlling a return of the hydraulic power to the remote source from the at least one hydraulic actuator; and controlling, with the at least one control valve in a second of the at least two states to close the at least one choke, the supply of the hydraulic power from the remote source to the second hydraulic port of the at least one hydraulic actuator, and controlling the return of the hydraulic power to the remote source from the at least one hydraulic actuator.

23. The method of claim 22, wherein disposing the at least one hydraulic actuator and the at least one control valve with the at least one choke comprises disposing them together on a skid at the first remote location.

24. The method of claim 22, further comprising:

disposing at least one accumulator with the at least one choke at the first remote location; and accumulating the supply of the hydraulic power upstream of the at least one control valve.

25. The method of claim 22, further comprising:

disposing a pair of pilot-operated check valves in fluid communication between the at least one control valve and the at least one hydraulic actuator; and controlling the supply and the return with the pair of pilot-operated check valves.

26. The method of claim 22, wherein disposing the at least one hydraulic actuator and the at least one control valve with the at least one choke at the first remote location comprises housing the at least one control valve on the hydraulic actuator.

27. The method of claim 22, further comprising receiving the return of the hydraulic power from the at least one control valve at a stage tank disposed with the at least one choke at the first remote location.

28. The method of claim 27, further comprising pumping the return from the stage tank to the remote source with a pump disposed with the at least one choke at the first remote location.

29. The method of claim 22, wherein controlling with the at least one control valve comprises electrically operating the at least one control valve between a first state of no flow, a second state of parallel flow, and a third state of cross flow between the supply and return with the at least one hydraulic actuator.

* * * * *